US008375469B2

(12) United States Patent
Duwyn-Zylstra

(10) Patent No.: US 8,375,469 B2
(45) Date of Patent: Feb. 19, 2013

(54) ADJUSTABLE HAT

(75) Inventor: Ann-Marie Duwyn-Zylstra, Niagara Falls (CA)

(73) Assignee: Ann-Marie Duwyn-Zylstra, Niagara Falls (CA)

( * ) Notice: Subject to any disclaimer, the term of this patent is extended or adjusted under 35 U.S.C. 154(b) by 104 days.

(21) Appl. No.: 12/609,895

(22) Filed: Oct. 30, 2009

(65) Prior Publication Data

US 2010/0043121 A1 Feb. 25, 2010

(51) Int. Cl.
*A42B 1/00* (2006.01)

(52) U.S. Cl. ..... 2/175.1; 2/175.3; 2/183; 2/209.11; 2/209.12

(58) Field of Classification Search ..... 2/175.1, 2/175.2, 175.3, 175.5, 171.1, 171.4, 171.5, 2/171.7, 171.8, 172, 181, 181.2, 182.1, 182.2, 2/183, 209.11, 209.12, 209.13, 209.4, 195.7, 2/175.4, 171.6, 181.4, 181.8, 182.7, 175.7, 2/195.1, 5, 6.1, 6.6
See application file for complete search history.

(56) References Cited

U.S. PATENT DOCUMENTS

| | | | | | |
|---|---|---|---|---|---|
| 191,061 | A | * | 5/1877 | Kuhlman | 2/272 |
| 714,731 | A | * | 12/1902 | Myers et al. | 2/181 |
| 919,984 | A | * | 4/1909 | Powell | 2/209.11 |
| 1,144,462 | A | * | 6/1915 | Cohen | 2/181 |
| 1,330,299 | A | * | 2/1920 | Ballard | 2/195.7 |
| 1,364,669 | A | * | 1/1921 | Winch | 2/172 |
| 1,534,181 | A | * | 4/1925 | Krainer | 2/183 |
| 1,557,280 | A | * | 10/1925 | Watson | 2/181 |
| 1,835,883 | A | * | 12/1931 | Lewis | 2/412 |
| 1,992,285 | A | * | 2/1935 | Blum | 2/183 |
| 2,051,084 | A | * | 8/1936 | Hertz | 2/195.7 |
| 2,112,383 | A | * | 3/1938 | Sloan et al. | 2/182.5 |
| 2,138,225 | A | * | 11/1938 | Borkland | 2/181.8 |
| 2,381,738 | A | * | 8/1945 | Grannan | 2/204 |
| 2,420,937 | A | * | 5/1947 | Dauster | 2/419 |
| 2,624,052 | A | * | 1/1953 | Redlin | 2/204 |
| 2,699,553 | A | * | 1/1955 | Harold et al. | 40/329 |
| 2,867,816 | A | * | 1/1959 | Rossett | 2/175.3 |
| 3,384,904 | A | * | 5/1968 | Hofmann | 2/195.7 |
| 4,334,325 | A | * | 6/1982 | Walkuski | 2/202 |
| 4,429,420 | A | * | 2/1984 | Wolff | 2/175.1 |
| 4,845,782 | A | * | 7/1989 | Gregg | 2/172 |
| 5,121,508 | A | * | 6/1992 | Grilliot et al. | 2/421 |
| 5,173,970 | A | * | 12/1992 | Shifrin | 2/410 |
| D339,677 | S | * | 9/1993 | Kang | D2/875 |
| 5,253,598 | A | * | 10/1993 | Rinehuls | 112/475.11 |
| D365,917 | S | * | 1/1996 | Armstrong | D2/881 |
| 5,495,622 | A | * | 3/1996 | Kaufman | 2/175.1 |
| 5,613,248 | A | * | 3/1997 | Young | 2/181.4 |
| 5,664,261 | A | * | 9/1997 | Lacy | 2/172 |
| 5,802,617 | A | * | 9/1998 | Boden | 2/183 |

(Continued)

*Primary Examiner* — Khoa Huynh
*Assistant Examiner* — Brieanna Fuller
(74) *Attorney, Agent, or Firm* — Gowling Lafleur Henderson LLP

(57) ABSTRACT

A hat includes a crown, a band and a resilient member. The crown includes a front having a first height; a rear having a second height wherein the second height is greater than the first height; an interior including a forward portion; an exterior including a rearward portion; and a circumferential bottom edge separating the interior and exterior. The band is coupled to the interior of the crown. The resilient member includes a first end, a second end, and an intermediate portion between the first and second ends, wherein the first end extends through the exterior rearward portion of the crown, and wherein the second end extends through the exterior rearward portion of the crown, and wherein the intermediate portion is positioned between the band and the interior of the crown.

13 Claims, 6 Drawing Sheets

U.S. PATENT DOCUMENTS 5,803,266 A * 9/1998 Blackwelder ..... 206/575
5,857,219 A * 1/1999 Edmark ..... 2/182.2
D413,710 S * 9/1999 De Rugeriis ..... D2/894
6,079,052 A * 6/2000 Veridiano ..... 2/172
6,256,794 B1 * 7/2001 Erickson ..... 2/209.11
6,484,323 B1 * 11/2002 Pu ..... 2/410
6,490,729 B1 * 12/2002 Dondero ..... 2/10
6,539,553 B2 * 4/2003 Day ..... 2/175.1
7,082,620 B1 * 8/2006 Rongione ..... 2/181
7,389,567 B2 * 6/2008 Rogers et al. ..... 24/113 R
2002/0162160 A1 * 11/2002 Anderson ..... 2/200.1
2008/0120762 A1 * 5/2008 Huang ..... 2/203

* cited by examiner

ADJUSTABLE HAT

BACKGROUND OF INVENTION

This application relates generally to hats and more particularly to adjustable hats.

SUMMARY

Hats are popular outerwear. Hats are frequently used to provide cover from the sun, rain and other elements. Given the numerous sized heads among the population, hats come in different preset sizes or are adjustable to accommodate a variety of users. Furthermore, hats not only provide protection, but are also frequently used as fashion accessories. This application discloses an adjustable hat that is comfortable, provides protection and optionally includes a variety of ornamental aspects for a user to selectively incorporate in the hat.

In particular, this application discloses a hat comprising: a crown comprising: a front having a first height; a rear having a second height wherein the second height is greater than the first height; an interior including a forward portion; an exterior including a rearward portion; and a circumferential bottom edge separating the interior and exterior; a band coupled to the interior of the crown; and a resilient member having a first end, a second end, and an intermediate portion between the first and second ends, wherein the first end extends through the exterior rearward portion of the crown, and wherein the second end extends through the exterior rearward portion of the crown, and wherein the intermediate portion is positioned between the band and the interior of the crown.

This application also discloses a hat comprising: a crown comprising: an interior including a front portion; an exterior including a rear portion; a circumferential bottom edge separating the interior and exterior; and wherein the crown is sized so that the bottom edge rests below the external occipital protuberance of a user; a band coupled to the interior of the crown; and a resilient member having a first end, a second end, and an intermediate portion between the first and second ends, wherein the first end extends through the exterior rear portion of the crown, and wherein the second end extends through the exterior rear portion of the crown, and wherein the intermediate portion is positioned between the band and the interior of the crown.

BRIEF DESCRIPTION OF THE DRAWINGS

The drawings, when considered in connection with the following description, are presented for the purpose of facilitating an understanding of the subject matter sought to be protected.

DETAILED DESCRIPTION

Referring now to FIGS. 1-6, an illustrative hat 100 is shown. The hat 100 generally includes a crown 102, a band 104 and a resilient member 106. While the illustrative hat 100 is shown as a bucket-style hat, it will be appreciated that the hat 100 may have any suitable style configuration and remain within the scope of the present disclosure, including, but not limited to, derby, akubra, cowboy, fedora, gatsby, hardee, panama, beret, slouch, sombrero, trilby, etc. The hat 100 may be formed from any suitable material. In one embodiment, the hat 100 is formed from a material having a UV 50+ rating that is also wicking and breathable. Additionally, in one embodiment, at least a portion of the hat 100 may be formed from a reflective material.

Figure 1A:
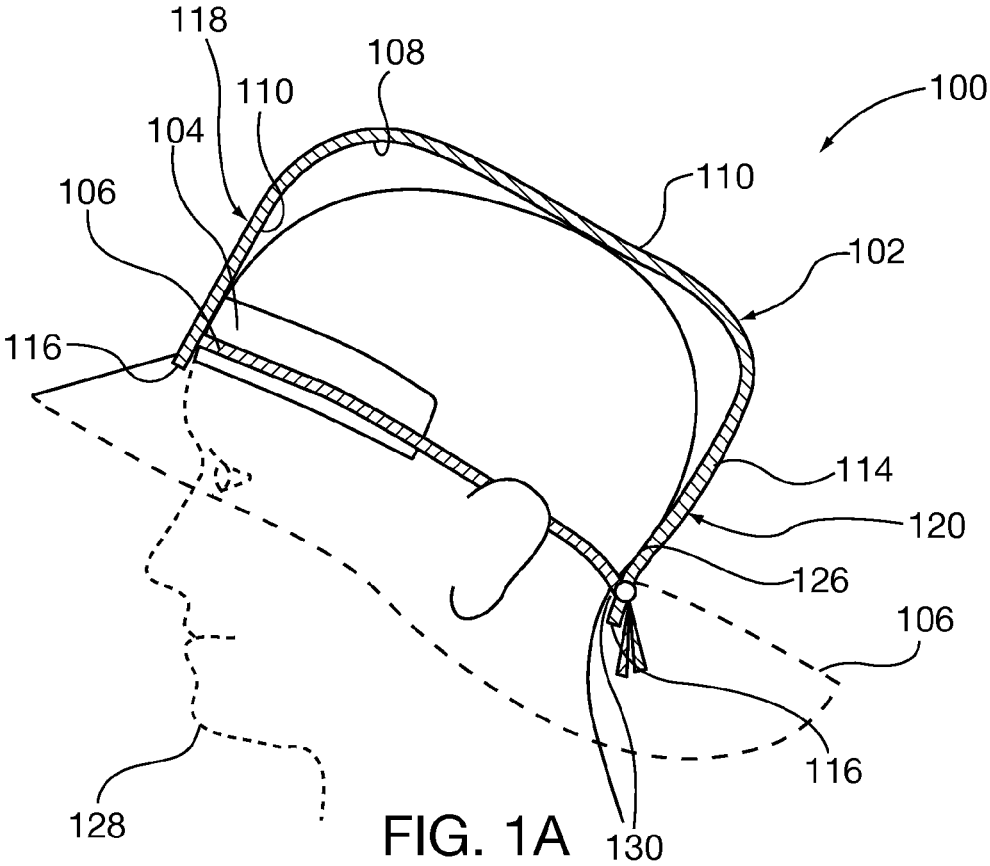
FIG. 1*a* is a schematic side view of a first embodiment of a hat.
Figure 1B:
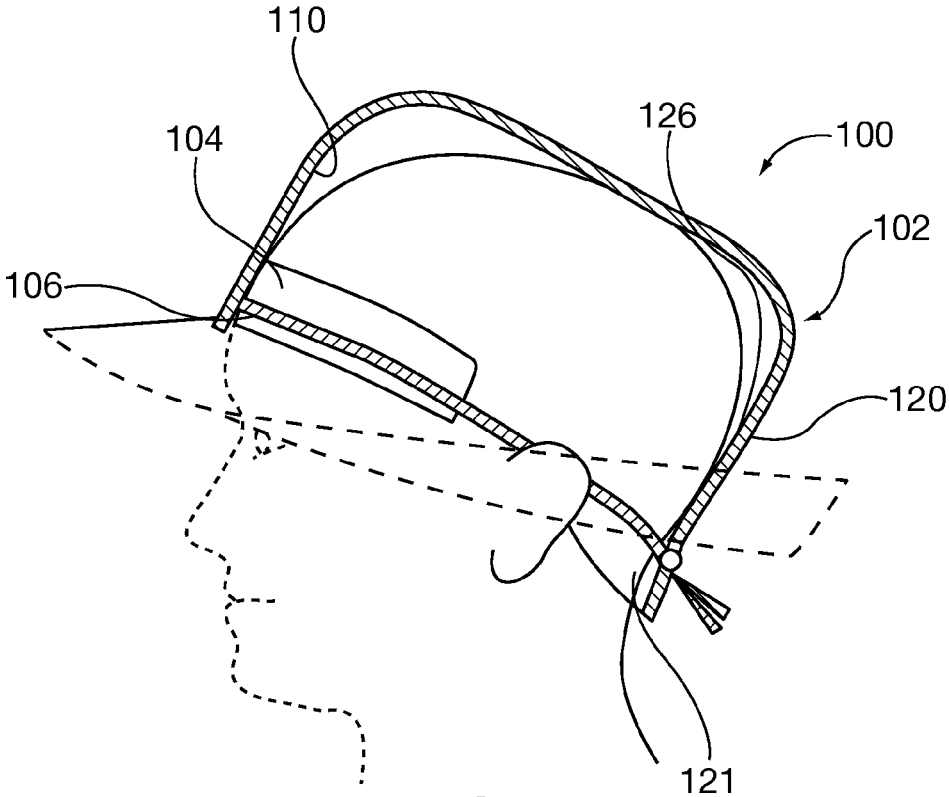
FIG. 1*b* is a schematic side view of a second embodiment of a hat.
Figure 2:
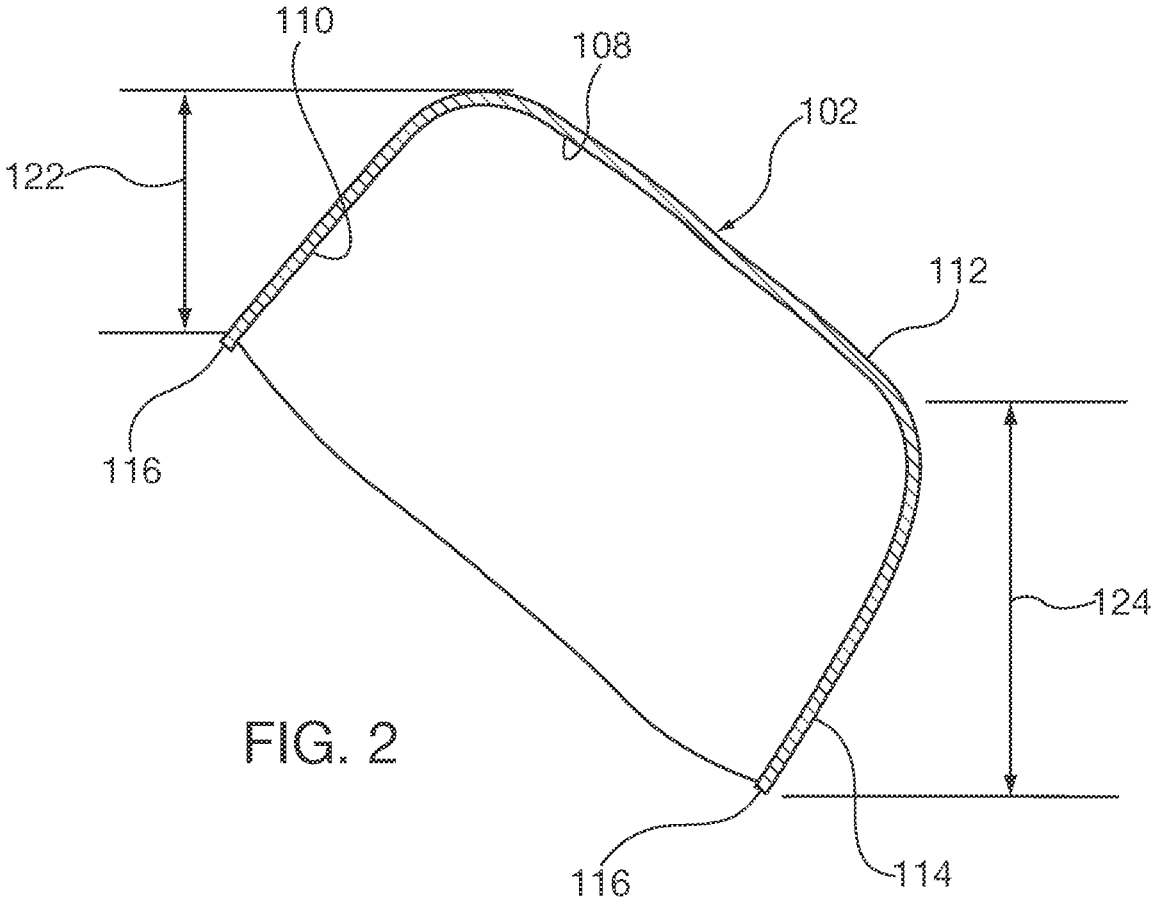
FIG. 2 is a schematic, cross-sectional view of a crown.
Figure 3:
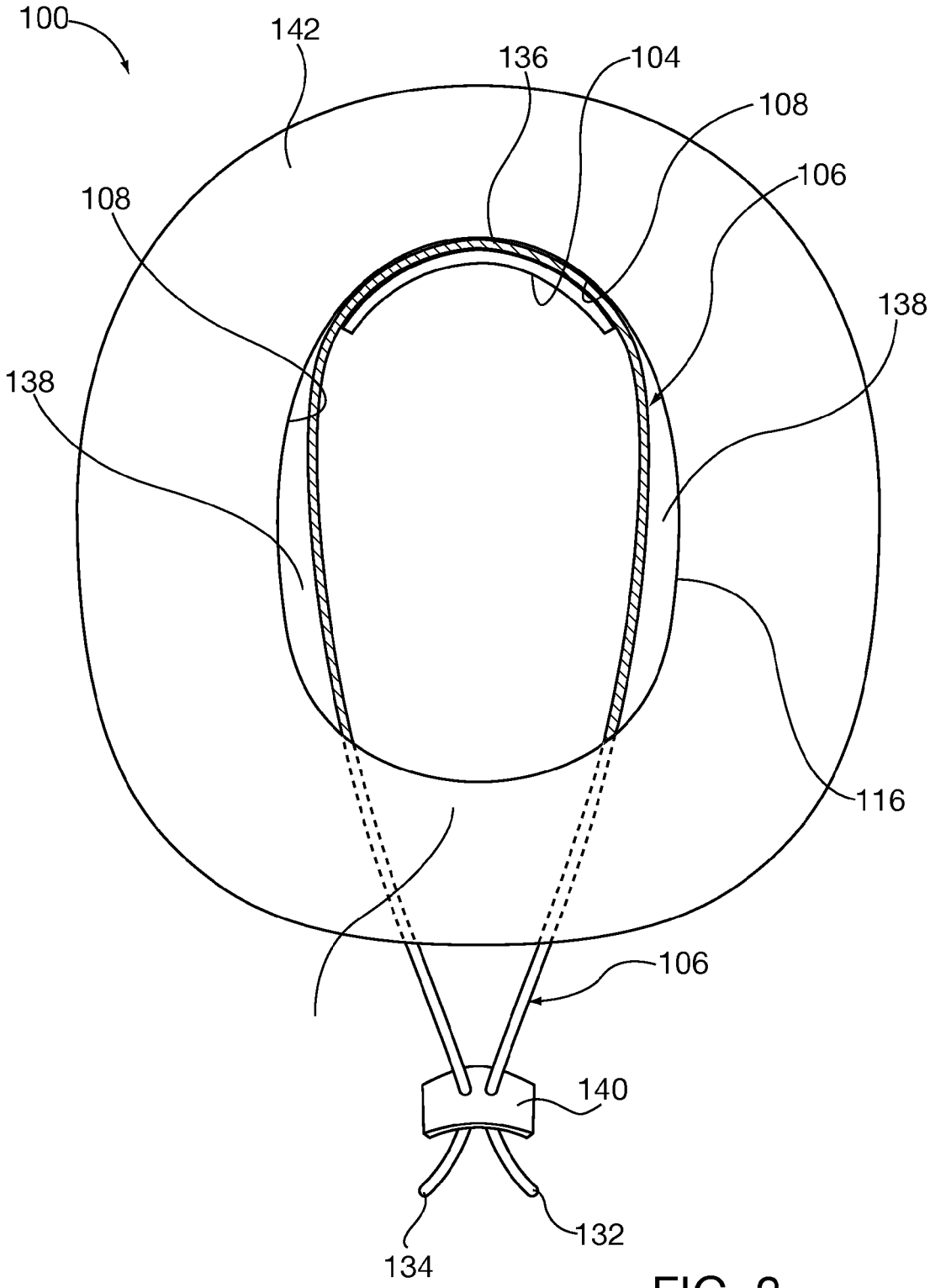
FIG. 3 is a bottom view of a hat.
Figure 4A:
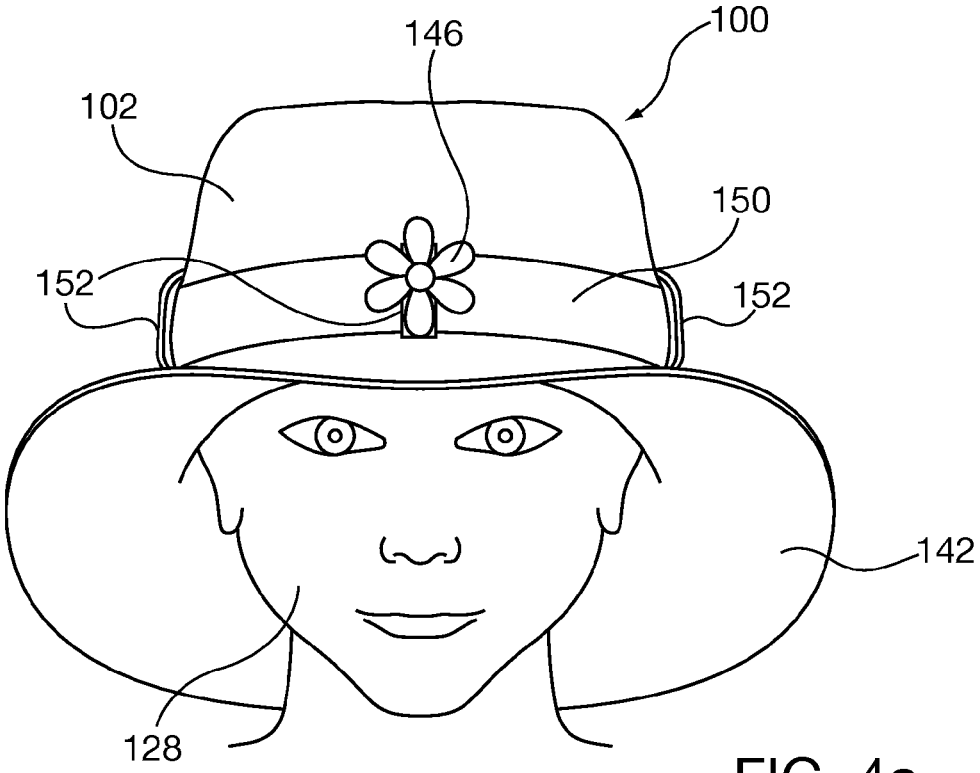
FIG. 4*a* is a front environmental view of a hat.
Figure 4B:
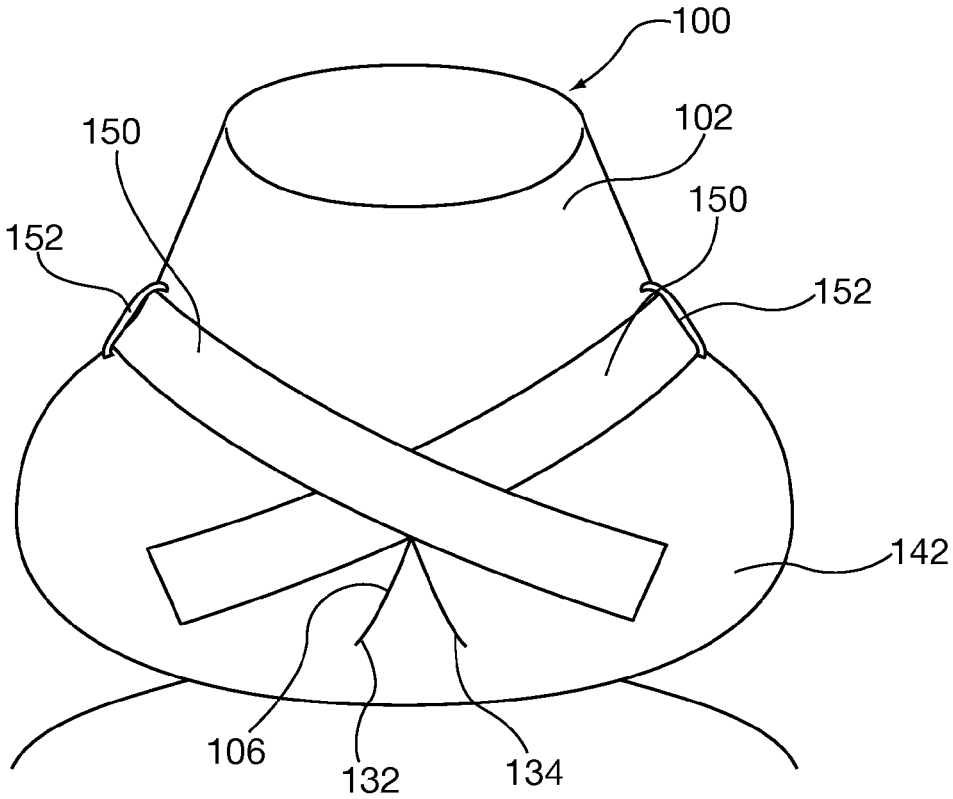
FIG. 4*b* is a rear environmental view of the hat of FIG. 4*a;*

The crown 102 includes an interior 108 having a forward portion 110. The crown 102 also includes an exterior 112 having a rearward portion 114. A circumferential bottom edge 116 separates the interior 108 and exterior 112. Furthermore, in one embodiment, the front 118 of the crown 102 has a first height 122 and the rear 120 of the crown 102 has a second height 124 wherein the second height 124 is greater than the first height 122. In one embodiment, the crown 102 is shaped, or otherwise sized, such that the rear of the bottom edge 116 rests below the occipital protuberance 126 of a user 128 when the user 128 is wearing the hat 100. Alternatively, the rear of the bottom edge 116 of the crown 102 may rest at the top of the nape of the neck 130 of the user 128. In an alternative embodiment, as shown in FIG. 1*b,* the rear 120 of the crown 102 may include a crown extension 121 that may rest below the occipital protuberance 126 of a user 128. The crown extension 121 may be added to an existing hat or be an integral part of an initial construction. The crown extension 121 is designed in such a manner that during a normal use and operation, the crown extension 121 is always adapted to be positioned completely below the entire external occipital protuberance of the user 128.

The band 104 is coupled to the interior 108 of the crown 102. The band 104 may be configured to absorb perspiration from the user 128. The band 104 may be positioned near the bottom edge of the crown 102. Additionally, the band 104 may be a circumferential piece that spans the entire circumference of the crown 102 or may be a smaller piece that does not span the entire circumference of the crown 102. In one embodiment, the band 104 is at least coupled adjacent to the forward portion 110 of the interior 108 of the crown 102.

The resilient member 106 includes a first end 132, a second end 134 and an intermediate portion 136 between the first and second ends 132, 134. The resilient member 106 may be formed from any suitable resilient material, including, but not limited to, rubber, an elastomer, Nylon®, any other suitable polymer, composite or the like. The intermediate portion 136 of the resilient member 106 is positioned between the band 104 and interior 108 of the crown 102. In one embodiment, the intermediate portion 136 is positioned between the forward portion 110 of the interior 108 of the crown 102 and the band 104. The first end 132 and second end 134 of the resilient member 106 extend through the exterior 112 of the crown 102. The resilient member 106 may be selectively tightened and loosened to accommodate users having different cranium sizes and/or adjust for a user's comfort. In one embodiment, once the resilient member 106 is tightened about the user's head, a gap 138 is formed between the resilient member 106 and the side portion of the bottom edge 116 of the crown 102 so that the gap 138 may provide increased ventilation to the interior 108 of the crown 102. The gap 138 also provides an area for the top portion of a user's ears such that the hat 100 can sit lower on the head without impinging on the ears. See FIG. 4*a*. The hat 100 may also include a toggle 140 releasably coupled to the resilient member 106 near at least one of the first and second ends 132, 134 wherein the resilient member 106 is operable to selectively tighten or loosen the resilient member 106. It will, however, be appreciated that the resilient member 106 may be tightened or loosened by any suitable means known in the art and such means are contemplated herein and considered part of the present disclosure. Once the hat 100 is disposed about the user's head, the resilient member 106 may be tightened such that the resilient member 106 engages the rear of the user's head below the occipital protuberance 126 to secure the hat 100 to the user's head.

Figure 5A:
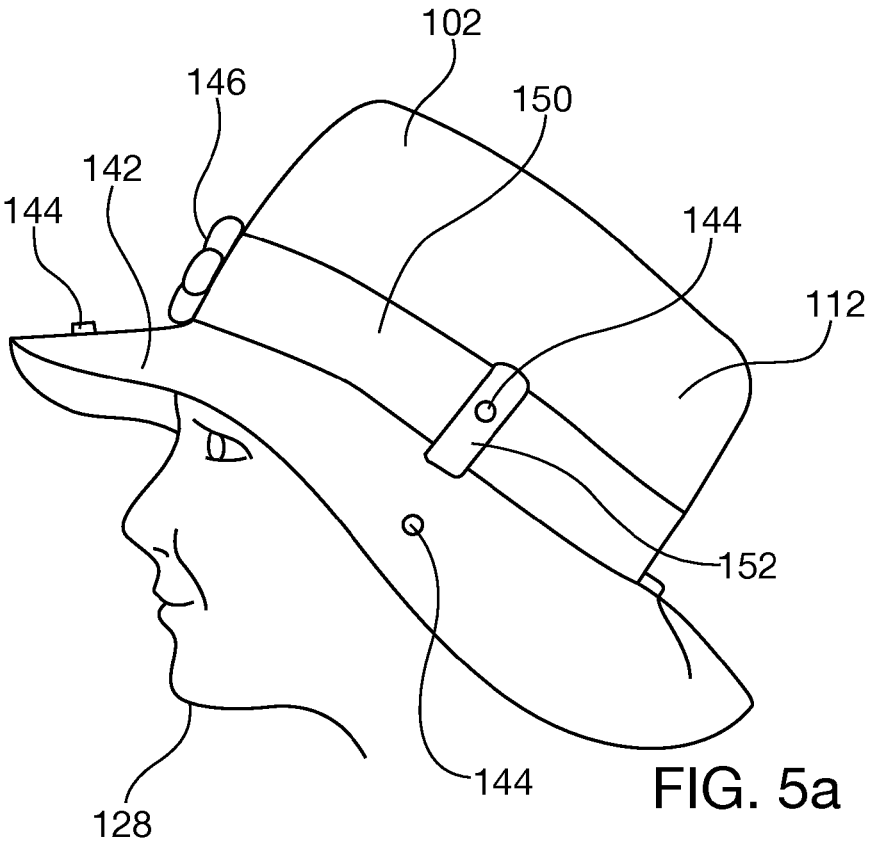
FIG. 5*a* is a side environmental view of a hat.
Figure 5B:
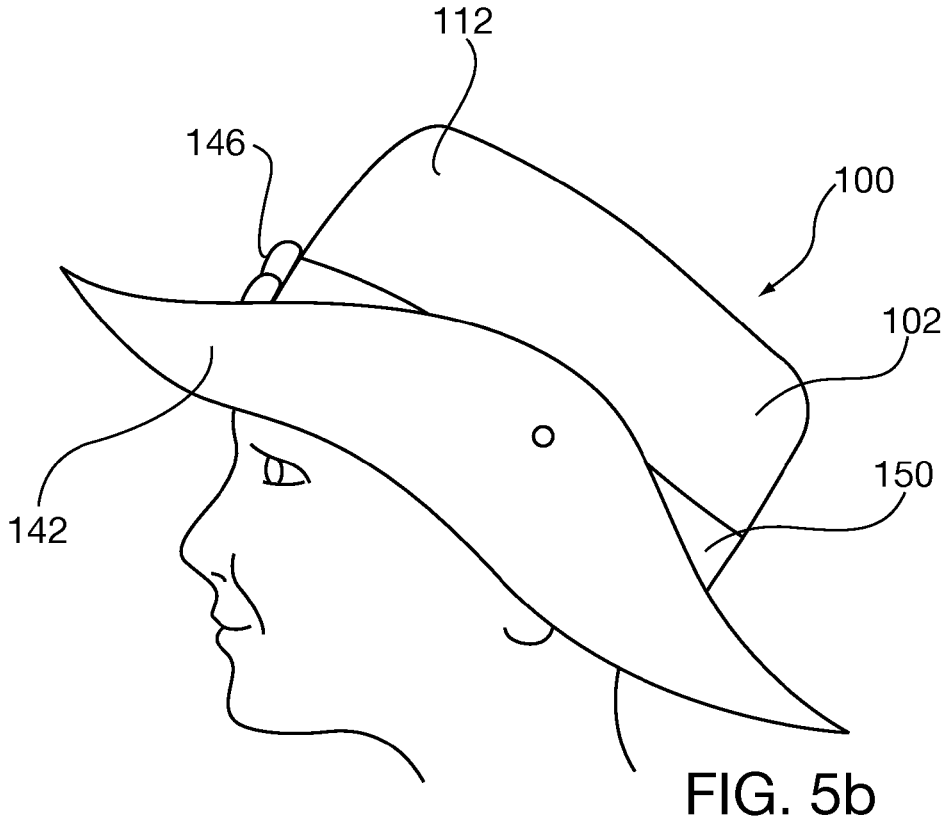
FIG. 5*b* is the hat of FIG. 5*a* with the brim in a brim second position.
Figure 5C:
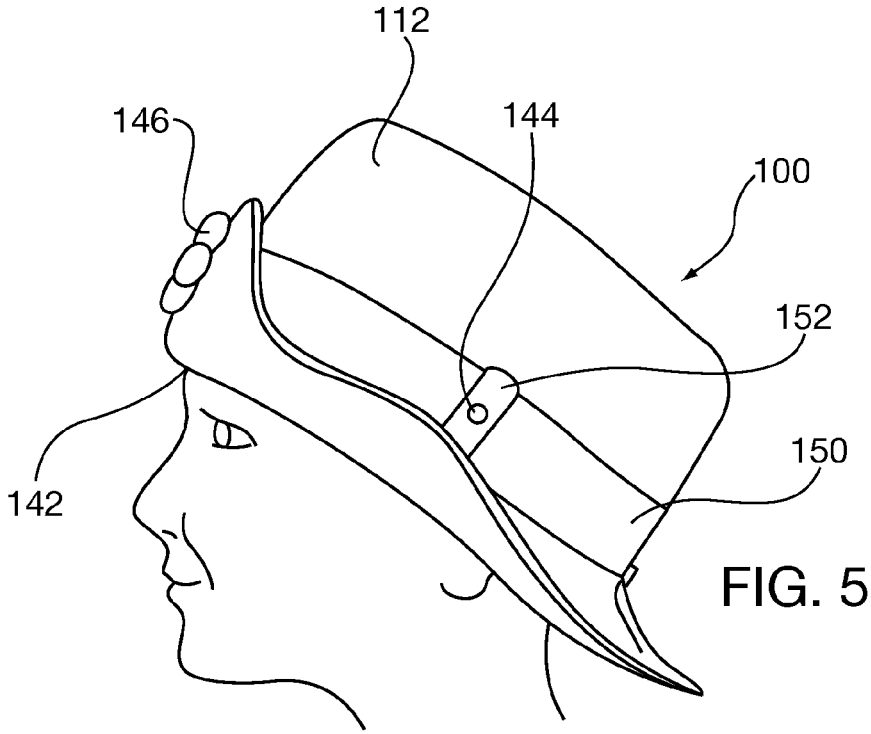
FIG. 5*c* is an alternative embodiment of the hat of FIG. 5*a* with the brim in a brim second position.
Figure 6:
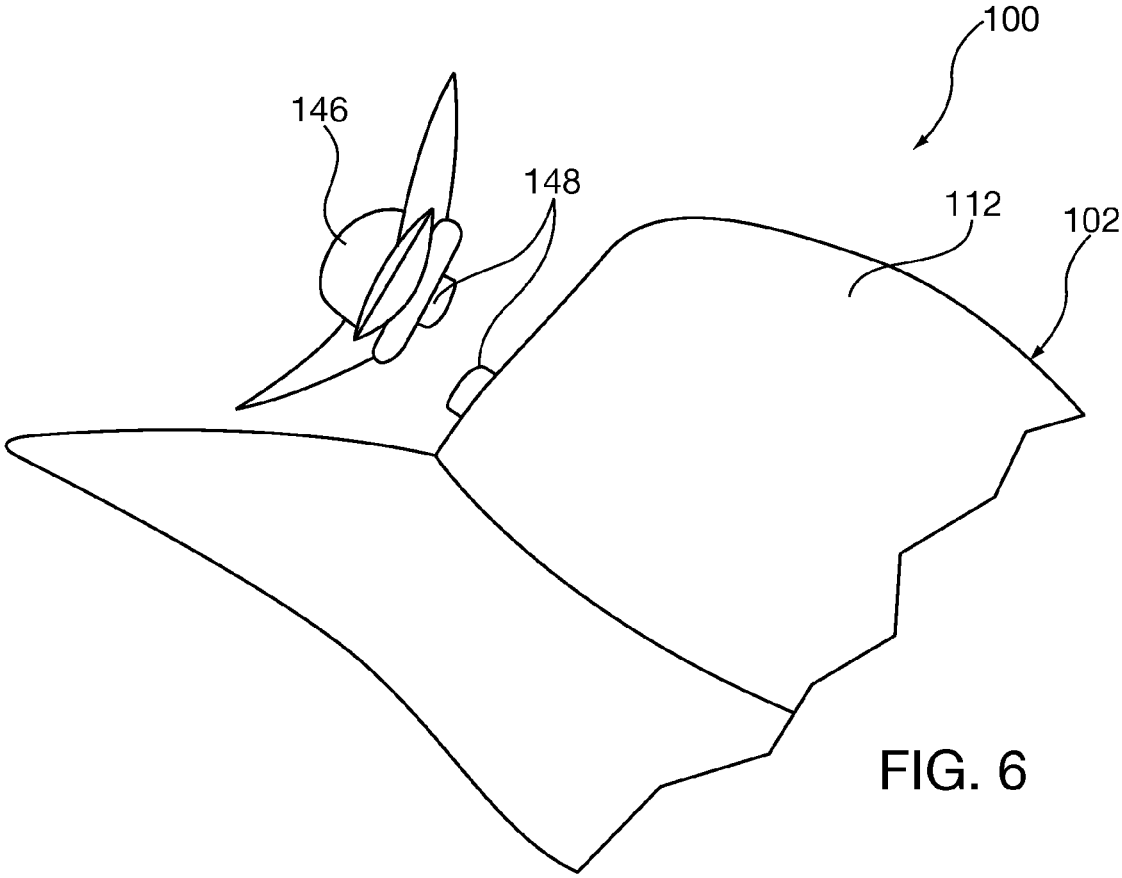
FIG. 6 is a schematic, partial side-view of a hat with an ornament.

In one embodiment, a circumjacent brim 142 is coupled to the crown 102. The brim 142 may be integral with the crown 102. Alternatively, the brim 102 may be sewn to the crown 102, or coupled to the crown 102 via any suitable means, including, but not limited to, adhesive, fasteners, mechanical fasteners, bonding, sonic welding or any other suitable coupling means. At least a portion of the brim 142 may be movable between a first position and a second position so that the hat 100 may have one or more configurations selectable by the user. With particular reference to FIGS. 5*a*-5*c*, one or more attachment devices 144 may be coupled to at least one of the brim 142 and crown exterior 112 wherein each attachment device 144 is configured to releasably secure the brim 142 in the brim second position. In one embodiment, the attachment device 144 is operable to couple the brim 142 to the crown exterior 112 so that the brim 142 may be secured in the brim second position. Suitable attachment device(s) 144 include, without limitation, a button assembly, a Velcro assembly, a buckle assembly, a clip assembly, a hook and loop assembly, a hook and catch assembly, a magnet assembly, an adhesive assembly, or any other suitable device, assembly or configuration operable to releasably couple the brim 142 in the brim second position to the crown 102. As shown in FIG. 5*b*, one or both sides of the brim 142 may be releasably coupled to the crown 102. Alternatively, as shown in FIG. 5*c*, the front and/or rear of the brim 142 may be releasably coupled to the crown 102. It will, however, be appreciated that any portion of the brim 142 may be releasably coupled in the brim second position to any suitable portion of the crown 102 and remain within the scope of the present disclosure.

The hat 100 may also include one or more ornaments 146 capable of being selectively and releasably coupled to the crown 102 and/or brim 142. The ornaments 146 may have any suitable configuration for selectively adding one or more ornamental aspects to the hat 100. At least one of each ornament 146 and crown 102 (and/or brim 142) may include an attachment device 148 for releasably coupling each ornament 146 to the hat 100. In one embodiment, at least one of the attachment device(s) 144 for securing the brim 142 in the brim second position to the crown 102 may be also employed to couple each ornament 146 to the hat 100. Alternatively, the attachment device(s) 148 for coupling each ornament 146 to the hat 100 may be separate from the attachment device(s) 144 for securing the brim 142 in the brim second position to the crown 102. The ornament or ornaments may be attached directly to the crown via attachment devices or, alternatively, attached via attachment devices to a loop portion 152. See FIG. 4*a* Suitable attachment device(s) 144 include, without limitation, a button assembly, a Velcro assembly, a buckle assembly, a clip assembly, a hook and loop assembly, a hook and catch assembly, a magnet assembly, an adhesive assembly, or any other suitable device, assembly or configuration operable to releasably couple each ornament to the hat 100.

The hat 100 may also include one or more ornamental belts 150 for selectively encompassing at least a portion of the crown 102. Each belt 150 may be formed from any suitable material for adding an ornamental aspect to the hat 100. In one embodiment, each belt 150 has two sides and is selectively reversable by a user such that one belt 150 may provide at least two different ornamental aspects to the hat 100. In one embodiment, the crown 102 includes at least one loop 152 for releasably receiving at least one belt 150 whereby each belt may be releasably secured to the hat 100. The belt 150 may be releasably coupled to itself at the rear of the hat 100 to assist in releasably securing the belt 150 to the hat 100. Alternatively, each belt 150 may be secured to the crown 102 with one or more attachment device(s) the same, or substantially similar, to those previously mentioned.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A hat (100) comprising:

a crown (102) comprising:

a front (118) having a first height;

a rear (120) having a second height wherein the second height is greater than the first height, an interior (108) and exterior (112) including a forward portion (110), a first side portion, a second side portion, a rearward portion (114), and a circumferential bottom edge (116) separating the interior (108) from the exterior (112) and spanning along and surrounding the front (118), the first side portion, the second side portion, and the rear (120); wherein the circumferential bottom edge (116) of the rear (120) only extends downwards from the first side portion and second side portion forming a crown extension (121) adapted to rest below the entire external occipital protuberance of a user (128) when the hat (100) is worn by the user (128); the crown extension (121) integrally formed with the rearward portion (114) and extending downwardly from the rearward portion such that the entire crown extension (121) always lies below a resilient member (106);

a band (104) positioned and surrounds the forward portion (110) of the interior (108) of the crown (102); the resilient member (106) coupled to the band (104), the resilient member (106) having a first end (132), a second end (134), and an intermediate portion (136) between the first (132) and second (134) ends, wherein the intermediate portion (136) of the resilient member (106) is positioned between the band (104) and the forward portion (110) at the interior (108) of the crown (102); the resilient member (106) extending through an interior side of the hat (100) from the band (104) to the rearward portion (114) of the crown (102) without touching the first side portion and the second side portion, thus forming a gap (138) between the resilient member (106) and the circumferential bottom edge (116) at each of the first side portion and the second side portion at the interior side of the crown (100), wherein the gap (138) is designed to receive the top portion of the user's (128) ear so that the hat (100) can sit lower on the user's (128) head without impinging upon the user's (128) ears when the hat (100) is worn; wherein the first end (132) and the second end (134) of the resilient member (106) further extends through the rearward portion (114) of the crown (102), above the circumferential bottom edge (116) of the rear (120) through the exterior (112) of the crown(102);

the resilient member (106) is designed to releasably engage the rear of the user's (128) head below the entire external occipital protuberance of the user (128) to secure the hat (100) to the user's (128) head; and wherein the crown extension (121) is designed in such a manner that during a normal use and operation, the crown extension (121) is always adapted to be positioned completely below the entire external occipital protuberance of the user (128).

2. The hat (100) of claim 1 further comprising a toggle (140) for selectively tightening and loosening the resilient member (106), the toggle (140) releasably coupled to at least one of the first (132) and second (134) ends of the resilient member (106).

3. The hat (100) of claim 1 further comprising a circumjacent brim (142) coupled to the crown (102).

4. The hat (100) of claim 3 wherein at least a portion of the circumjacent brim (142) is movable between a first position and a second position.

5. The hat (100) of claim 4 further comprising at least one attachment device (144) coupled to at least one of the circumjacent brim (142) and the crown (102), the at least one attachment device (144) for selectively coupling the circumjacent brim (142) to the crown (102) when the circumjacent brim (142) is in the second position.

6. The hat (100) of claim 1 further comprising an ornament (146) for releasably coupling to the crown (102).

7. The hat (100) of claim 1 further comprising an ornamental belt (150) for selectively surrounding the crown (102).

8. The hat (100) of claim 7 wherein the crown (102) includes one or more loops (152) for receiving the ornamental belt (150).

9. The hat (100) of claim 1 further comprising an ornament (146) and at least one attachment device (144) coupled to at least one of the ornament (146) and the exterior (112) of the crown (102) whereby the ornament (146) is capable of being releasably coupled to the exterior (112) of the crown (102).

10. A hat (100) comprising:

a crown (102) comprising: a front (118) and a rear (120);

an interior (108) and exterior (112) including a forward portion (110), a first side portion, a second side portion, a rearward portion (114), and a circumferential bottom edge (116) separating the interior (108) from the exterior (112) and spanning along and surrounding the front (118), the first side portion, the second side portion, and the rear (120); wherein the circumferential bottom edge (116) of the rear (120) only extends downwards from the first side portion and second side portion forming a crown extension (121) adapted to rest below the entire external occipital protuberance of a user (128) when the hat (100) is worn by the user (128); the crown extension (121) integrally formed with the rearward portion (114) and extending downwardly from the rearward portion such that the entire crown extension (121) always lies below a resilient member (106);

a band (104) positioned and surrounds the forward portion (110) of the interior (108) of the crown (102); the resilient member (106) coupled to the band (104), the resilient member (106) having a first end (132), a second end (134), and an intermediate portion (136) between the first (132) and second (134) ends, wherein the intermediate portion (136) of the resilient member (106) is positioned between the band (104) and the forward portion (110) at the interior (108) of the crown (102); the resilient member (106) extending through an interior side of the hat (100) from the band (104) to the rearward portion (114) of the crown (102) without touching the first side portion and the second side portion, thus forming a gap (138) between the resilient member (106) and the circumferential bottom edge (116) at each of the first side portion and the second side portion at the interior side of the crown (100), wherein the gap (138) is designed to receive the top portion of the user's (128) ear so that the hat (100) can sit lower on the user's (128) head without impinging upon the user's (128) ears when the hat (100) is worn; wherein the first end (132) and the second end (134) of the resilient member (106) further extends through the rearward portion (114) of the crown (102), above the circumferential bottom edge (116) of the rear (120) through the exterior (112) of the crown(102);

the resilient member (106) is designed to releasably engage the rear of the user's (128) head below the entire external occipital protuberance of the user (128) to secure the hat (100) to the user's (128) head; and wherein the crown extension (121) is designed in such a manner that during a normal use and operation, the crown extension (121) is always adapted to be positioned completely below the entire external occipital protuberance of the user (128).

11. The hat (100) of claim 10 further comprising a toggle (140) for selectively tightening and loosening the resilient member (106), the toggle (140) releasably coupled to at least one of the first (132) and second (134) ends of the resilient member (106).

12. The hat (100) of claim 10 further comprising an ornament (146) and at least one attachment device (144) coupled to at least one of the ornament (146) and the exterior (112) of the crown (102) whereby the ornament (146) is capable of being releasably coupled to the exterior (112) of the crown (102).

13. The hat (100) of claim 12 wherein the attachment device (144) is a button assembly, a buckle assembly, a clip assembly, a hook and loop assembly, a hook and catch assembly, a magnet assembly, or an adhesive assembly.

* * * * *